US006808089B2

(12) United States Patent
Hashimoto et al.

(10) Patent No.: US 6,808,089 B2
(45) Date of Patent: Oct. 26, 2004

(54) POWDER FILLING METHOD AND POWDER FILLING APPARATUS

(75) Inventors: Yasuhiro Hashimoto, Takasago (JP); Yoshikazu Seki, Takasago (JP); Masahiro Murakami, Takasago (JP)

(73) Assignee: Kobe Steel, Ltd.

( * ) Notice: Subject to any disclaimer, the term of this patent is extended or adjusted under 35 U.S.C. 154(b) by 0 days.

(21) Appl. No.: 10/207,136

(22) Filed: Jul. 30, 2002

(65) Prior Publication Data

US 2003/0037833 A1 Feb. 27, 2003

(30) Foreign Application Priority Data

Jul. 30, 2001 (JP) ..... 2001-230061

(51) Int. Cl.[7] ..... B22F 1/00

(52) U.S. Cl. ..... 222/162; 222/161; 222/217; 222/221; 141/1; 141/11; 141/69; 141/280; 141/284; 141/364; 419/38

(58) Field of Search ..... 141/1, 11, 69, 141/280, 284, 364; 222/161, 162, 216, 217, 221; 419/38

(56) References Cited

U.S. PATENT DOCUMENTS 5,672,363 A * 9/1997 Sagawa et al. ..... 425/3
6,299,832 B1 * 10/2001 Kohara et al. ..... 419/38
6,511,631 B2 * 1/2003 Kuniyoshi et al. ..... 419/38

FOREIGN PATENT DOCUMENTS

JP 57-82496 5/1982
JP 6-40851 2/1994
JP 6-30813 8/1994
JP 07195346 A * 8/1995 ..... B28B/13/00
JP 2952190 9/1999
JP 00088993 A * 3/2000 ..... G21C/21/02
JP 3183097 7/2001

OTHER PUBLICATIONS

Y. Hashimoto, et al., World Congress on Powder Metallurgy & Particulate Materials, Session 8, pp. 24–26, "Improvement of Die Filling by Agitating–Shoe", Jun. 16–21, 2002.

PM$^2$TEC 2002 World Congress, 3 pages, "2002 World Congress on Powder Metallurgy & Particulate Materials," Jun. 16–21, 2002.

2 pages, "Hitachi Powder Metallurgy Technical Exchange," Mar. 26, 2002.

Y. Hashimoto, et al., Kobe Steel, Ltd. Steel Powder Technology Section, 26 pages, Improvement of Die Filling by "Agitating–Shoe".

* cited by examiner

*Primary Examiner*—J. Casimer Jacyna
(74) *Attorney, Agent, or Firm*—Oblon, Spivak, McClelland, Maier & Neustadt, P.C.

(57) ABSTRACT

Disclosed is a powder filling method in which powder is filled in a powder box having a discharging port at its bottom segment, the powder box is moved over a cavity to be targeted while being slid on a die plate, thereafter the powder in the powder box is dropped into the cavity by its own gravitational force and filled there, wherein the powder in the powder box is applied with a mechanical agitation when the powder in the powder box is at least dropped into the cavity in the powder filling method for filling the powder in the powder box while being dropped at least into the cavity.

4 Claims, 5 Drawing Sheets

POWDER FILLING METHOD AND POWDER FILLING APPARATUS

BACKGROUND OF THE INVENTION

1. Field of the Invention

This invention relates to a powder filling method in which powder is filled in a powder box, thereafter the powder is moved over a cavity arranged at a die plate and the powder is dropped into the cavity by its gravitational force.

2. Description of the Related Art

In the case of manufacturing a metallic sintered component parts, for example, in the prior art, raw material powder attained by mixing various kinds of metallic powder represented by iron powder with lubricant agent or the like is filled in the cavity (a molding die) to perform its molding operation, thereafter the molded product is put into a furnace for performing a sintering operation. When the raw material powder is filled in the cavity, there is provided usually a method, as shown in FIG. 1 in which the powder 3 is filled in advance in the powder box 1 having a discharging port 2 opened at its bottom segment and set over a die plate 4, the powder box 1 is fixed to the extremity end of the rod 6, the powder box is slid on the die plate 4 at a specified speed by a driving mechanism such as a hydraulic cylinder (not shown), the powder 3 in the powder box 1 is dropped into the cavity 5 to be targeted by its own gravitational force through the discharging port 2.

However, when the powder 3 is filled from the powder box 1 into the cavity in this way, the system having a complex shape of the cavity 5 or poor filling characteristic or poor flowing characteristic in reference to the type of powder produces a poor filling of the powder into the cavity 5 or disturbance in particle size or substances and the like, resulting in that this state becomes one of the causes of poor quality.

As means for solving such problems, there have been proposed, in the prior art, one method for filling powder while a moving speed of the powder box is being decreased and the other method for filling the powder by flowing out gas through some fine holes in a pipe installed in the powder box while the powder is being floated.

Although the former method could not attain an improvement of filling rate as expected to cause its productivity to be decreased and the latter method was expected to have a substantial effect for improving the filling rate and the like, these prior art methods had some problems that their structures were complex and it was necessary to perform a precise control over supplying of gas, and so it could not say that they were sufficient methods.

Further, as already disclosed in JP-A No. 300,194/1996, although there has been proposed a method for mounting a reciprocatable fork in the powder box, this prior art merely provided an effect for scraping off the bridge formed in the powder box and dropping it, so that it showed a certain limitation in improvement of the filling rate and so this prior art method was not a sufficient method.

This invention has been invented as its subject matter to overcome the aforesaid prior art problems, drop the powder positively into the powder box by a simple constitution and means without damaging its productivity and improve the filling rate.

SUMMARY OF THE INVENTION

In order to improve some problems in the prior art described above, the present inventors have earnestly performed various kinds of experiment and studies and finally completed the present invention as the advantageous solving means for overcoming the aforesaid problems.

According to one aspect of the present invention, there is provided a powder filling method in which powder is filled in a powder box having a discharging port at its bottom segment, the powder box is moved over a cavity to be targeted while being slid on a die plate, thereafter the powder in the powder box is dropped into the cavity by its own gravitational force and filled there, wherein when the powder in the powder box is at least dropped into the cavity, the powder in the powder box is applied with a rotary agitation.

According to another aspect of the present invention, there is provided a powder filling method in which the rotary agitation is performed by a mechanical rotary agitation.

According to another aspect of the present invention, there is provided a powder filling method in which the rotary agitation is performed by a mechanical rotary agitation with its substantial vertical direction being applied as a rotating axis.

According to still another aspect of the present invention, there is provided a powder filling apparatus comprising a powder box movably arranged over a die plate; a motor arranged at the powder box; and a rotary agitating machine arranged in the powder box and rotated through driving of the motor with a substantial vertical direction being applied as an axis.

According to yet another aspect of the present invention, there is provided a powder filling apparatus in which the rotary agitating machine has a plurality of agitating rods.

DETAILED DESCRIPTION OF THE PREFERRED EMBODIMENTS

Figure 1:
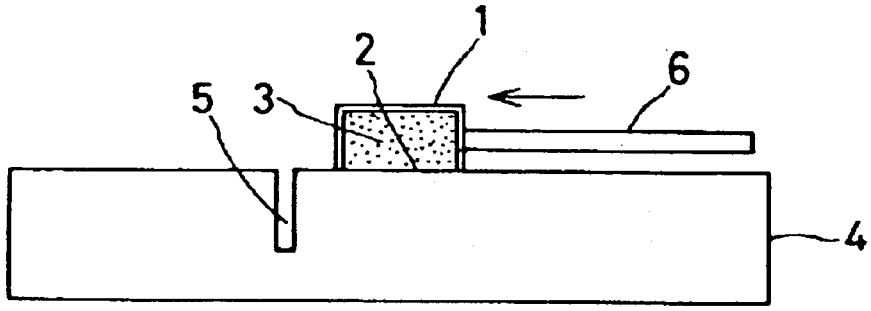
FIG.1 PRIOR ART
FIG. 1 is an entire schematic view for illustrating a general method for filling powder in a powder box into a cavity.

Referring now to the drawings, some preferred embodiments of the present invention will be described as follows.

At first, we have studied several times about a poor filling of powder into a cavity which is a major problem and found that its major cause consists in the fact that replacement between the powder and air in the cavity is not carried out smoothly when the powder is dropped into the cavity by its own weight. Then, as means for realizing the smooth replacement between the powder and the air, we have found that a uniform rotating agitation is applied to the powder in the powder box, the rotating agitation is preferably a mechanical agitation and in particular, a method for dropping the powder into the cavity and filling it while the rotating agitation with a vertical direction perpendicular to the surface of the powder in the powder box being applied as a rotating axis is being uniformly applied over an entire region in the powder box is most suitable for the operation.

Figure 2:
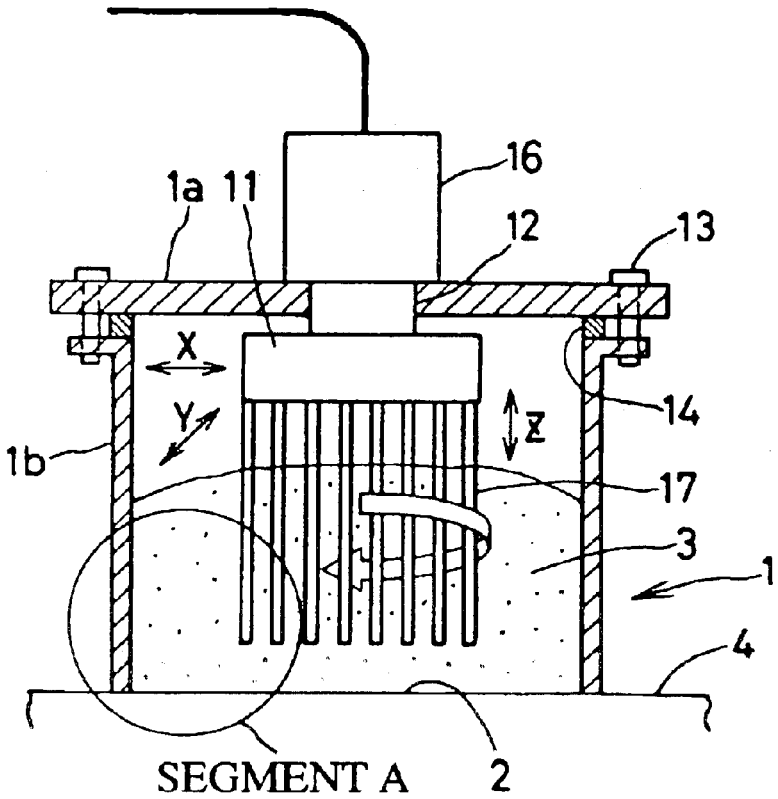
FIG. 2 is an entire view for showing a powder supplying device used in the present invention where an agitating means (an agitator) is installed in the powder box.

FIG. 2 is an entire view for showing a powder supplying device in which an agitating means (an agitator) is installed in the powder box. An agitator 10 is installed at the central segment in the powder box 1, wherein the agitator is comprised of a rotary disk 11 connected to a motor 16 through a supporting box 12, and several agitating rods 17 of small diameter (eight agitating rods in this case) arranged below the rotary disk in a comb-like manner in a vertical direction. The agitating rods 17 are removably arranged at the rotary disk and the number of the rods to be installed or their types (length or thickness and the like) can be changed.

Figure 3:
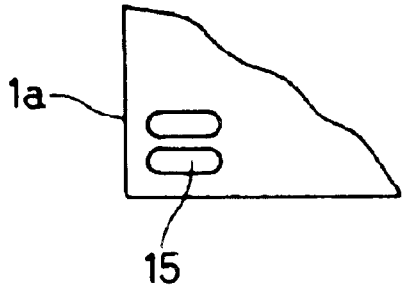
FIG. 3 is a top plan view of FIG. 2 with a part being broken away.

In turn, the powder box 1 is comprised of an upper plate la and a side plate 1*b*, wherein it has no bottom segment (a bottom plate) and this forms a discharging port 2. A supporting box 12 for the agitator 10 is fixed to the upper plate la of the powder box 1. In addition, the side end segment of the upper plate 1*a* and the upper end segment of the side plate 1*b* are removably and integrally fixed by bolts 13, a spacer 14 for adjusting a height position is installed at the fixed segment, either the thickness of the spacer 14 or the number of the spacers 14 to be stacked is changed to enable its position in a height direction (the direction Z in the figure) of the agitator 10 to be adjusted. As shown in FIG. 3, each of the corners of the upper plate 1*a* is formed with two longitudinal holes 15 for the bolts 13, the fixing positions of the upper plate 1*a* in respect to the side plate 1*b* with the bolts 13 are selected under utilization of the longitudinal holes 15 to enable the positions of the agitator 10 in both vertical and lateral directions (the X, and Y directions of arrows in the figure) to be adjusted.

Further, although a constitution has been indicated in the preferred embodiment that the position of the agitator 10 can be adjusted manually, the position may be adjusted automatically using the electric or hydraulic mechanism.

Then, the method of the present invention, i.e. a method for actually filling powder 3 into the cavity 5 under application of such an agitating and supplying device will be described as follows. At first, as shown in FIG. 1, the rod 6 of a hydraulic cylinder is retracted to cause the device to be set at a motion starting position (the right end on the die plate 4 in FIG. 1), the specified amount of powder 3 of which substances are adjusted is charged in the powder box 1 as shown in FIG. 2, thereafter the agitating machine 10 is adjusted to an appropriate position in a lateral horizontal direction and a height direction. Then, the motor 16 is driven, the rotary disk 11 is rotationally driven around its vertical axis and the agitating rods 17 are rotated in a horizontal direction as indicated by an arrow in FIG. 2.

Further, the number of rotation of the agitating machine 10, i.e. the number of rotation of the rotary disk 11 has been set in advance to an appropriate value in response to the substances, density and other features of the powder 3. The powder 3 in the powder box 1 is agitated and flowed under application of the rotating power of the agitating rods 17.

Then, in concurrent with a starting in rotation of the agitating machine 10, the rod 6 (FIG. 1) of the agitating and supplying device is extended under an operation of the hydraulic cylinder connected to the agitating and supplying device and the rod moves toward the cavity 5 of the target while sliding on the die plate 4. A free fall of the powder 1 starts when the front side plate 1*b* of the powder box 1 starts to advance into the opening of the cavity 5, a requisite amount of powder is dropped into the cavity 5 while the powder box 1 passes over the cavity 5, and then its filling operation is completed.

Further, although a more preferable agitating time has been described in the preferred embodiment of the present invention as one ranging from its setting to the motion starting position of the powder box 1 to a completion of the filling operation dropping the powder 3 into the cavity 5 to finish it, it is at least preferable if the agitation is carried out during a time starting the powder dropping operation to finishing of its filling operation and so the object of the present invention as well as its effect can be sufficiently accomplished even if the agitating operation is started during motion of the powder box or just before the dropping of powder into the cavity 5 is started.

Figure 4:
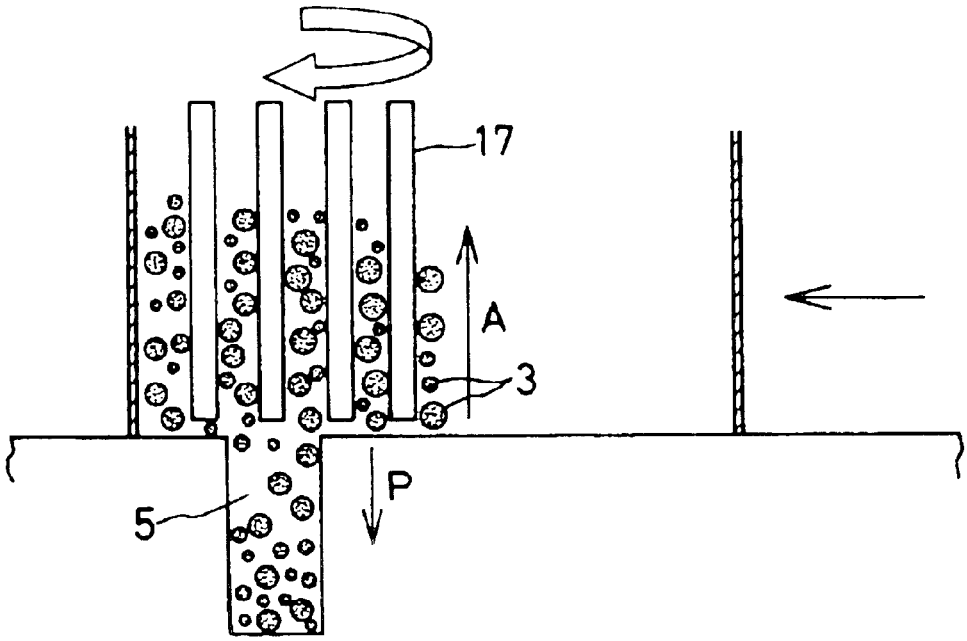
FIG. 4 is a schematic view for illustrating a state when powder in the powder box is dropped into the cavity by an agitating and supplying device.
Figure 5:
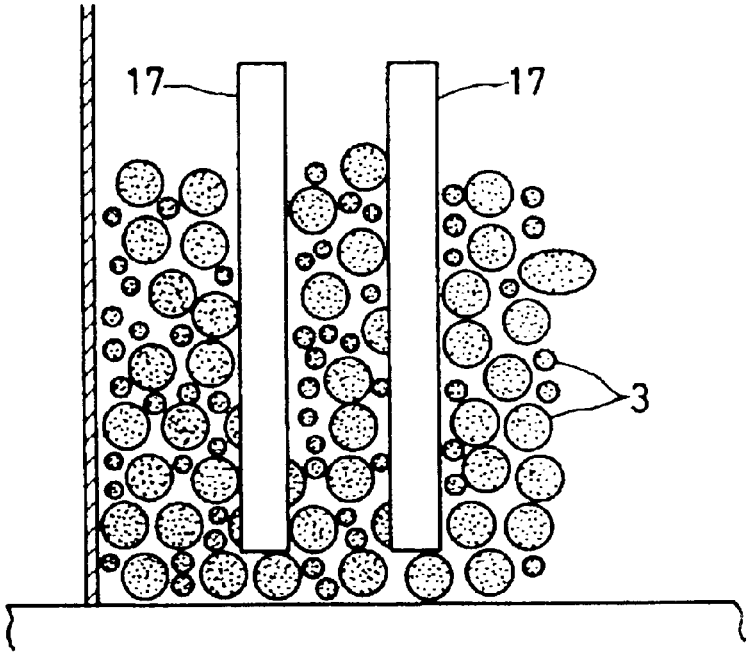
FIG. 5 is an enlarged schematic view for showing a segment A in FIG. 2 to illustrate a filled state of powder 3 in the powder box 1 before a mechanical agitation is applied in accordance with the present invention.
Figure 6:
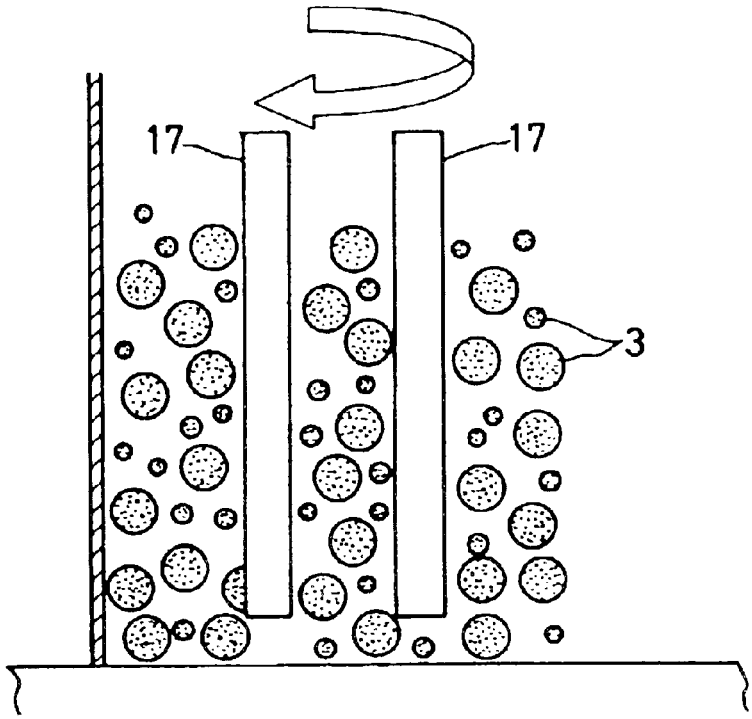
FIG. 6 is an enlarged schematic view for showing the segment A in FIG. 2 to illustrate a filled state of powder 3 in the powder box 1 to which a mechanical agitation is applied in accordance with the present invention.

FIG. 4 is a schematic view for showing a state when the powder 3 in the powder box 1 is dropped into the cavity 5 by the agitating and supplying device in this way. FIGS. 5 and 6 are enlarged schematic views for showing the segment A in FIG. 2 to indicate the filling state of the powder 3 in the powder box 1 before and after performing the agitating operation. As shown in FIG. 4, the dropped powder is replaced with air in the cavity when the powder 3 is dropped into the cavity 5, the powder 3 freely drops by a gravity force acting in itself and in turn the air present in a space in the cavity 5 is pushed out of the cavity and then the air moves upward in the powder box 1 as indicated by an upward arrow A in the figure. In order to perform a smooth replacement of the powder with air, it becomes a major key-point how well the air pushed out of the cavity 5 is lifted and moved in the powder box 1 and discharged out of it.

If a uniform mechanical agitation is applied to the powder 3 in the powder box 1 under application of the aforesaid agitating and supplying device in accordance with the method of the present invention, the powder 3 closely filled in the powder box is agitated and flowed with a rotational energy of the agitating rods 17 in a horizontal direction as apparent from a comparison between FIGS. 4 and 5, resulting in that its occupying volume is expanded and it keeps a rough state in which the inter-particles of the powder are expanded as shown in FIG. 5. A clearance formed between the powder particles becomes a motion passage, i.e. a replacement path within the powder box 1 for the air discharged out of the cavity 5, resulting in that the powder dropped into the cavity 5 and the air present there are smoothly replaced to each other.

Forming of the replacement path accompanied by this agitating operation promotes a smooth replacement between the powder in the cavity and the air, the powder dropped into the cavity shows no disturbance in its substances and density, resulting in that the powder is filled in its uniform state and under a high density. In addition, its productivity is also improved because the powder can be filled at a high speed. Further, it is possible to perform it easily because a device having a relative convenient constitution is sufficiently applied.

As to the direction of rotational agitating operation, although the embodiment in which its vertical direction is applied as an axis has been described, meaning of this vertical direction in the present invention is not severely understood, but it includes a case in which the rotation is performed around the axis inclined in a horizontal direction at a certain angle (45° or less) in respect to the vertical line.

In addition, some physical values such as a rotating speed of the agitating machine, a distance between the bottom of the powder box and the end of each of the agitating rods and a shape of each of the agitating rods are changed to cause a flowing state of powder in the powder box to be changed and its filling characteristic can be controlled.

Additionally, as to the rotating speed at this rotating agitation, it is preferable to perform it within a range of 20 to 150 rpm for keeping a high filling density in particular and performing a uniform filling as apparent from the examples to be described later.

EXAMPLES

Referring to some examples, although the present invention will be described in further detail, it should be understood that the following methods for performing the present invention do not limit or restrict the present invention and its design changes in reference to the aforesaid gist or the gist to be described later are included in the technical scope of the present invention.

Example 1

Pure iron powder with average particle diameter of 70 $\mu$m and apparent density of 3.0 g/cm$^3$ was used as a target powder, the powder was loaded into the powder box, its motion into the cavity, its dropping into the cavity and its filling into the cavity were carried out in a rectangular cavity with a thickness of 2 mm, a width of 50 mm and a depth of 45 mm formed in a die plate in accordance with the aforesaid procedure under application of the agitating and supplying device shown in FIG. 2. The rotational driving in this case was carried out by an electrical motor, the agitation was started in concurrent with motion of the powder into the cavity and performed at the rotating speed of 100 rpm by the eight agitating rods with a diameter of 4.0 mm fixed to the agitating machine in a comb-like manner. A fixing space for each of the agitating rods was 20 mm and a distance between the bottom of the powder box and the lower end of each of the agitating rods was set to be 5 mm.

Figure 7:
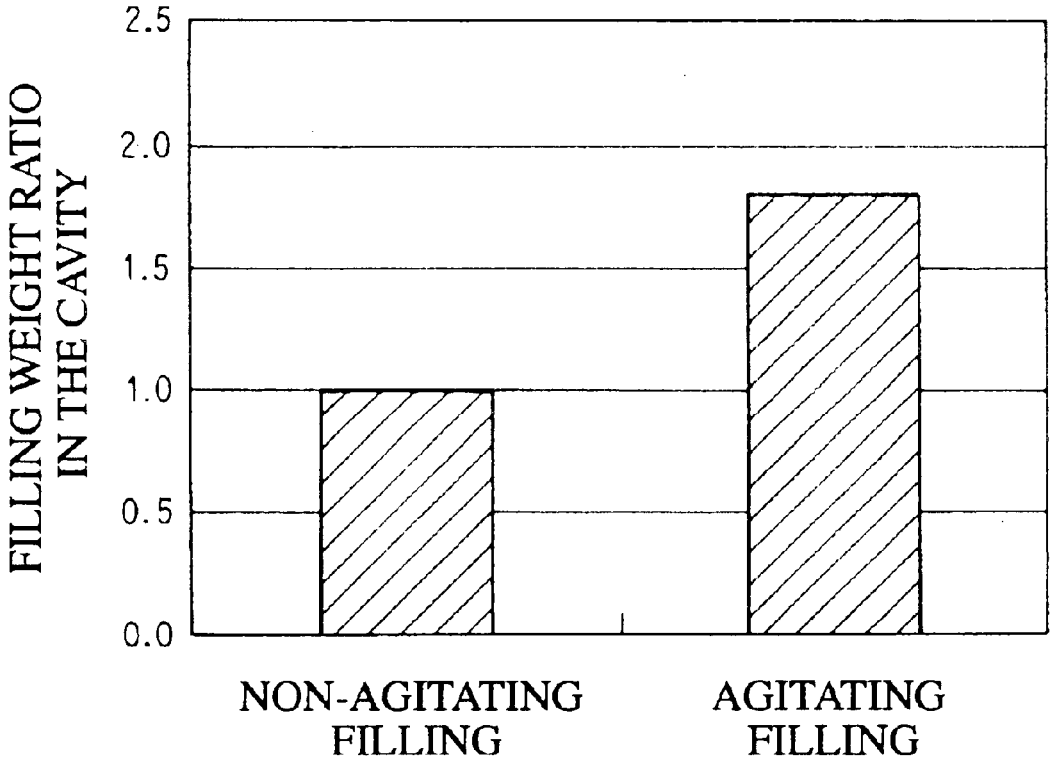
FIG. 7 is an illustrative view for indicating a result in which a weight of powder dropped into the cavity is measured and its filling characteristic is evaluated under application of both the present invention (a rotating agitation) and the prior art method (a non-agitation)

FIG. 7 shows a result in which a weight of powder dropped into the cavity is measured in accordance with the method of the present invention and its filling characteristic is evaluated. Additionally, FIG. 7 shows it together with the result of evaluation in the case that the powder is not agitated for a sake of comparison. A filling weight ratio in the cavity at an ordinate axis in this figure is a value of the weight ratio when an iron powder filling amount at the time of filling in non-agitating operation (the prior art) is defined as 1. As apparent from this state, in accordance with the agitating and filling operation of the method of the present invention, it becomes a filling amount by 1.8 times of that of the non-agitating and filling operation of the prior art method and it shows that a quite high filling rate can be attained.

Example 2

Figure 8:
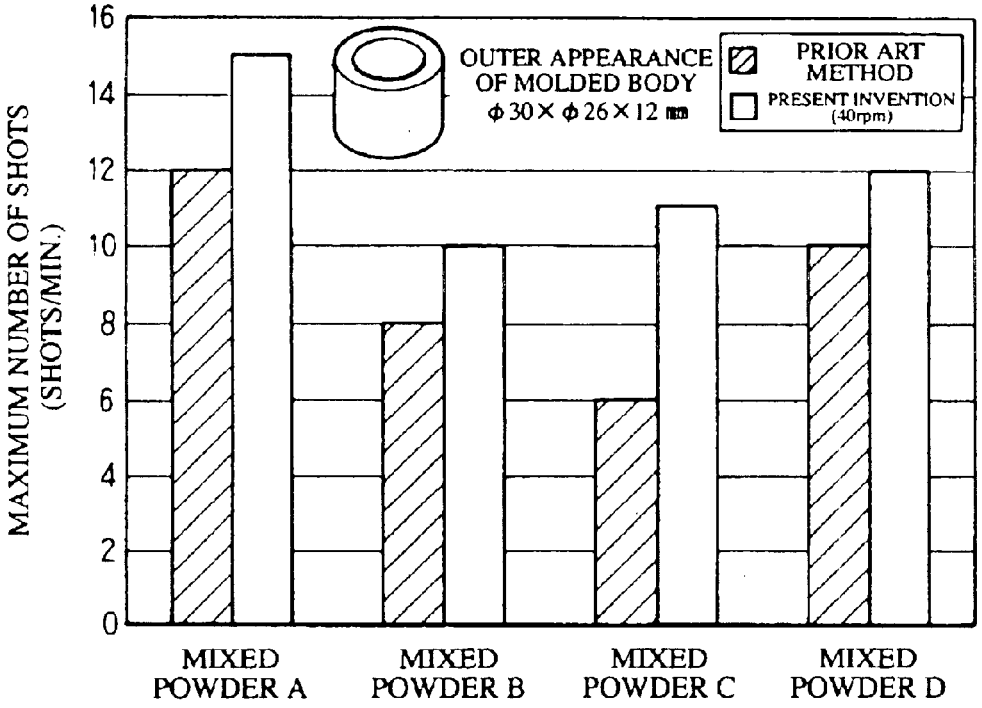
FIG. 8 is an illustrative view for indicating a result in which the maximum number of shots is surveyed when a filling of powder and a molding of powder are carried out in the cavity under application of both the present invention (a rotating agitation) and the prior art method (a non-agitation)

Mixed iron powders (balance being iron) composed of four types (A to D) indicated below was used as target powders, the powders were loaded into the powder box, their motion into the cavity, their dropping into the cavity, their filling into the cavity and their molding were carried out in a ring-like cavity with an inner diameter of 26 mm, an outer diameter of 30 mm, a width of 2 mm and a height of 12 mm arranged in a die plate according to the same procedure as that of the aforesaid example 1. In this case, all the rotational speeds for the agitating operation were set to 40 rpm and for a sake of comparison, all the rotating speeds for the non-agitating operation were set. Then, in FIG. 8 is indicated a result of surveying the maximum number of shots per minute where the cavity is fully filled. Additionally, in FIG. 8 is also indicated an outer appearance of the attained ring-like molded member.

(1) Mixed powder A: 0.6% graphite+2% Cu+lubricant A
Average particle diameter: 70 $\mu$m
Apparent density: 3.40 g/cm$^3$
(2) Mixed powder B: 0.6% graphite+2% Cu+lubricant B
Average particle diameter: 70 $\mu$m
Apparent density: 3.44 g/cm$^3$
(3) Mixed powder C: 2% graphite+2% Bronze+lubricant C
Average particle diameter: 70 $\mu$m
Apparent density: 3.37 g/cm$^3$
(4) Mixed powder D: 0.6% graphite+2% Cu+lubricant C
Average particle diameter: 70 $\mu$m
Apparent density: 3.00 g/cm$^3$ In reference to FIG. 8, it becomes apparent that all the powders filled under a rotary agitation (the right side bar graphs) show the maximum number of shots as compared with that of the powders filled under a non-agitation (the left side bar graphs) and their filling speeds are improved. In particular, it is noticed that the mixed powder C having a less degree of filling characteristic shows a high increasing rate of the maximum number of shots (83%) and the improved effect caused by the present invention is remarkably realized.

Example 3

Figure 9:
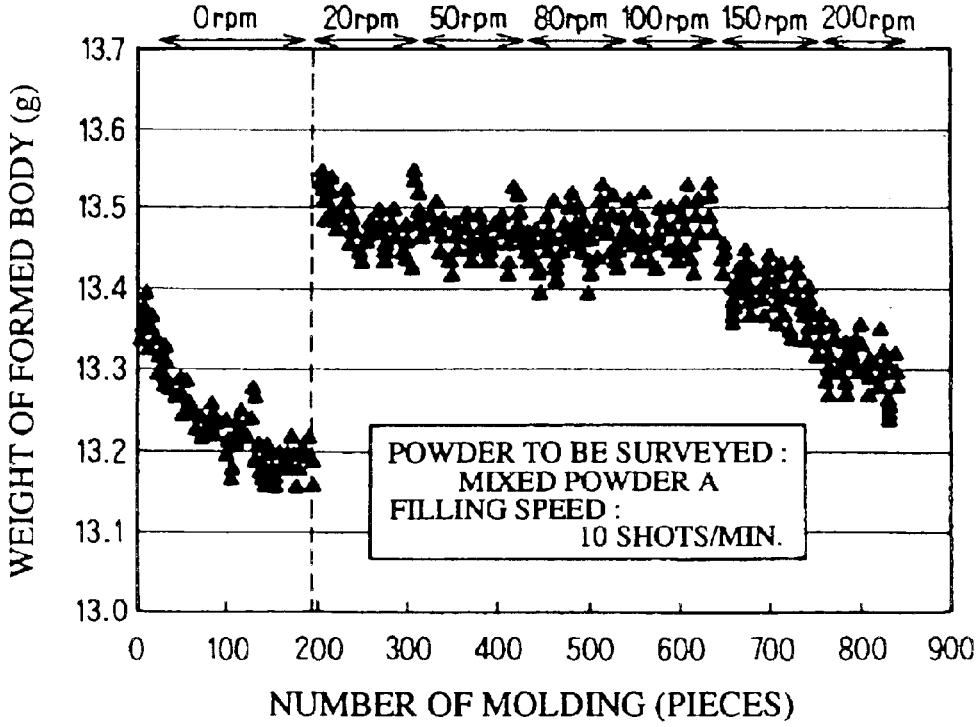
FIG. 9 is an illustrative view for indicating a result in which a weight of molded body is surveyed when a filling of powder and a molding of powder are carried out in the cavity under application of both the present invention (a rotating agitation) and the prior art method (a non-agitation).

Then, both filling and molding were carried out in the same ring-like cavity under a constant filling speed (10 shots per minute) while performing the rotary agitation under various kinds of rotating speeds (20 to 200 rpm) with the mixed powder A in the example 2 above being applied as an object. In addition, the non-agitation (0 rpm) was also carried out. In FIG. 9 is indicated a result in which influence of rotational speed applied to a weight of the ring-like molded body attained in this way was surveyed.

In reference to FIG. 9, it becomes apparent that although the molded body for the non-agitating operation (0 rpm) shows a light weight and a high disturbance, the molded body for the rotating agitation shows a heavy weight and a low disturbance. Then, checking an influence of the rotating speed clarifies the fact that the weight of the molded body is particularly high within a speed range of about 20 to 150 rpm, its disturbance is quite low and stable.

As described above, the present invention performs a smooth replacement between air and powder through a replacement path formed between the powder particles in the powder box under an agitating action due to its dropping into the cavity and agitation of the powder while applying a uniform mechanical agitation to the powder in the powder box. As a result, the present invention provides a superior effect that a uniform and high density filling of powder having no segregation in substance and particle size can be carried out. In addition, even when the powder box is moved at a high speed, a filling rate of the powder can be kept high, so that the present invention can provide some advantageous effects together that its productivity can be improved and further the device used and the facility applied can be constituted by a relative simple configuration and they can be worked easily.

What is claimed is:

1. A powder filling method for powder of iron or mixed iron powder containing graphite and a metal other than iron in a powder box having a discharging port at its bottom segment, comprising the steps of:

sliding the powder box on a die plate having a cavity, such that the discharging port of the powder box moves over the cavity, permitting the powder in the powder box to drop into the cavity by its own gravitational force and fill the cavity;

providing an agitator comprising a plurality of agitating rods;

adjusting a height of the agitator in the powder box; and during said step of permitting the powder in the powder box to drop into the cavity, agitating the powder in the powder box by rotary agitation about a substantially vertical axis using said agitator.

2. The powder filling method according to claim 1, wherein the rotary agitation is performed by a mechanical rotary agitation.

3. The powder filling method according to claim 1, wherein the rotary agitation is applied substantially over an entire region in said powder box.

4. A powder filling apparatus comprising:

a powder box arranged to be movable over a die plate;

a motor arranged at the powder box;

a rotary agitating machine arranged in the powder box and having a plurality of agitating rods which are rotatable by said motor about a substantially vertical axis; and height adjusting means for adjusting a height of said rotary agitating machine in the powder box.

* * * * *

UNITED STATES PATENT AND TRADEMARK OFFICE

CERTIFICATE OF CORRECTION

PATENT NO. : 6,808,089 B2
DATED : October 26, 2004
INVENTOR(S) : Hashimoto et al.

It is certified that error appears in the above-identified patent and that said Letters Patent is hereby corrected as shown below:

Title page,
Item [73], Assignee, should read:
-- [73] Assignee: Kabushiki Kaisha Kobe Seiko Sho (Kobe Steel, Ltd.) Kobe-shi (JP) --

Signed and Sealed this

First Day of February, 2005

JON W. DUDAS
*Director of the United States Patent and Trademark Office*